US005326092A

United States Patent [19]

Ando

[11] Patent Number: 5,326,092

[45] Date of Patent: Jul. 5, 1994

[54] APPARATUS FOR CONVEYING A PAPER ALONG WITH A PAPER CONVEYING PATH

[75] Inventor: Koichi Ando, Kanagawa, Japan

[73] Assignee: Kabushiki Kaisha Toshiba, Kawasaki, Japan

[21] Appl. No.: 1,098

[22] Filed: Jan. 6, 1993

[30] Foreign Application Priority Data

Jan. 10, 1992 [JP] Japan ..... 4-002553
Oct. 13, 1992 [JP] Japan ..... 4-273276

[51] Int. Cl.[5] ..... B65H 5/00

[52] U.S. Cl. ..... 271/272; 271/81; 198/369

[58] Field of Search ..... 271/225, 272, 279, 308, 271/81, 256, 302; 198/369

[56] References Cited

U.S. PATENT DOCUMENTS 591,223 10/1897 North ..... 271/81
3,713,735 1/1973 Wilber ..... 271/272
4,179,112 12/1979 Breyers et al. ..... 271/272
4,277,061 7/1981 Nagel et al. ..... 271/302
4,822,025 4/1989 Chung ..... 271/302
4,890,826 1/1990 Rutishauser ..... 271/302
5,222,730 6/1993 Miyake ..... 271/302

FOREIGN PATENT DOCUMENTS 62-187866 8/1962 Japan ..... G03G 15/00

*Primary Examiner*—H. Grant Skaggs
*Attorney, Agent, or Firm*—Limbach & Limbach

[57] ABSTRACT

An apparatus for conveying a paper along a paper conveying path, the apparatus includes a pair of guide plates for guiding a paper in the paper conveying path, the guide plates being movable between a first position located in the paper conveying path and a second position located out of the paper conveying path and a roller located in the paper conveying path for conveying the paper. The roller is rotated in response to the moving of the guide plates from the first position to the second position so that the paper in the paper conveying path is fed from the guide plates.

1 Claim, 7 Drawing Sheets

APPARATUS FOR CONVEYING A PAPER ALONG WITH A PAPER CONVEYING PATH

BACKGROUND OF THE INVENTION

1. Field of the Invention

The present invention relates to a paper conveying apparatus located in a paper supply unit, an automatic document feeder, an automatic paper reversing unit and etc. in an image forming apparatus.

2. Description of the Related Art

In a conventional image forming apparatus such as a copying machine, if a paper jam occurs in a paper conveying path formed by a guide plate which guides paper conveying, the drive of the image forming apparatus is stopped and the jammed paper is removed by one of the following methods. If the leading or trailing edge of the paper is projecting from the leading or trailing edge of the guide plate, the paper is simply pulled out. Even if the leading or trailing edge of the paper is not projecting from the guide plate, conveyor rollers provided in the conveying path are manually rotated, the paper is conveyed by the conveyor rollers to make the paper project from the edge of the guide plate and then the paper is pulled out.

In the prior art, when a paper jam occured and the paper did not project from the leading edge or the trailing edge of the guide plate, the paper had to be made to project from the guide plate leading edge by manually rotating the conveyor rollers to feed the paper. Thus there was a problem of requiring time for removing jammed paper, so that operability was reduced.

SUMMARY OF THE INVENTION

It is an object of the present invention to provide a paper conveying apparatus with efficient operability which is capable of making a paper project from a leading edge of a guide plate when removing a jammed paper, without requiring to manually rotate conveyor rollers, and thus removing the jammed paper simply and quickly.

According to the present invention there is provided an apparatus for conveying a paper along with a paper conveying path, the apparatus comprising means for guiding a paper in the paper conveying path, means for supporting the guiding means movably between a first position located in the paper conveying path and a second position located out of the paper conveying path, means for conveying a paper by rotating, and means for rotating the conveying means associated with the movement of the guiding means while the guiding means is moving from the first position to the second position.

DETAILED DESCRIPTION OF THE PREFERRED EMBODIMENTS

Referring to the accompanying drawings, a detailed description will subsequently be given of the preferred embodiment of the present invention.

Figure 1:
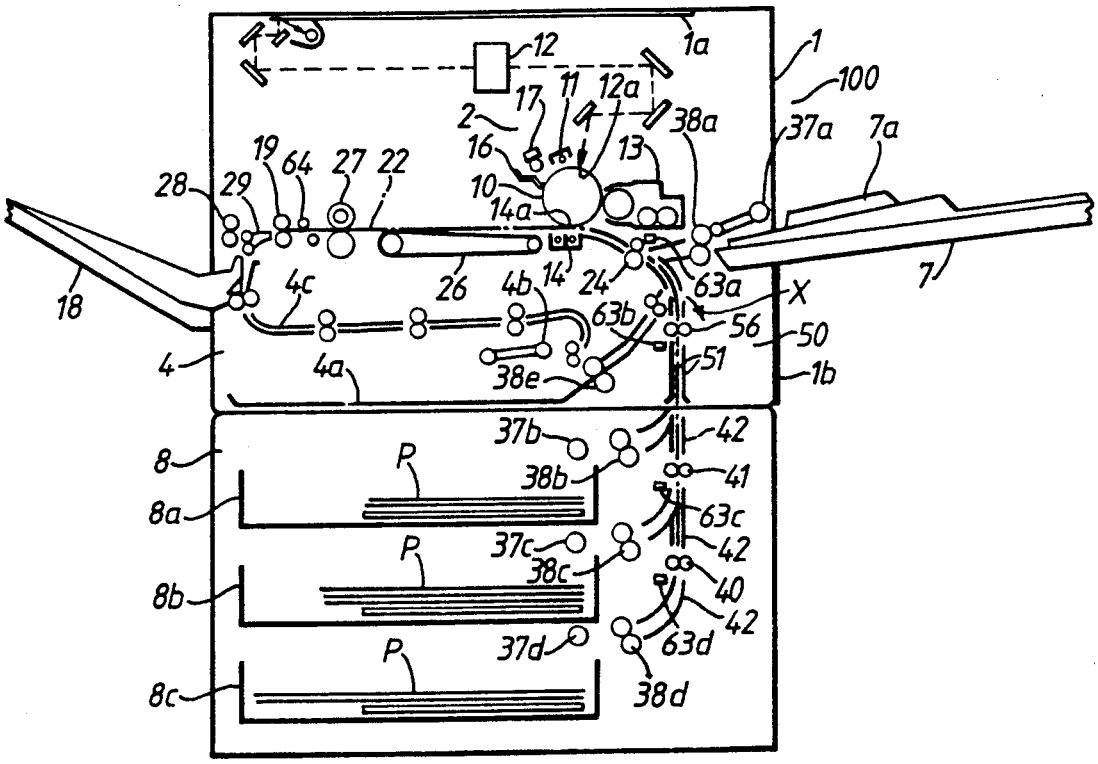
FIG. 1 is a sectional view showing an image forming apparatus in which a paper conveying apparatus according to a first embodiment of the present invention is accomodated.
Figure 2:
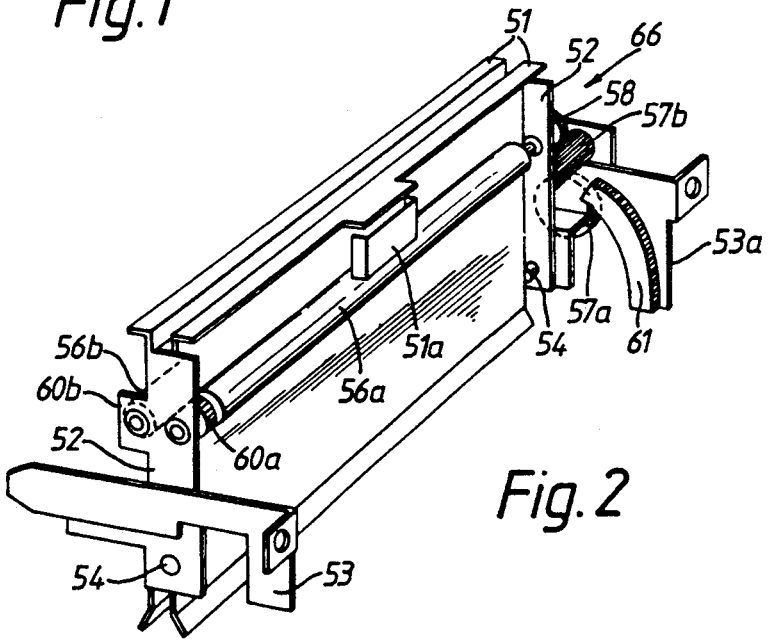
FIG. 2 is a perspective view showing the paper conveying apparatus of the first embodiment.
Figure 3:
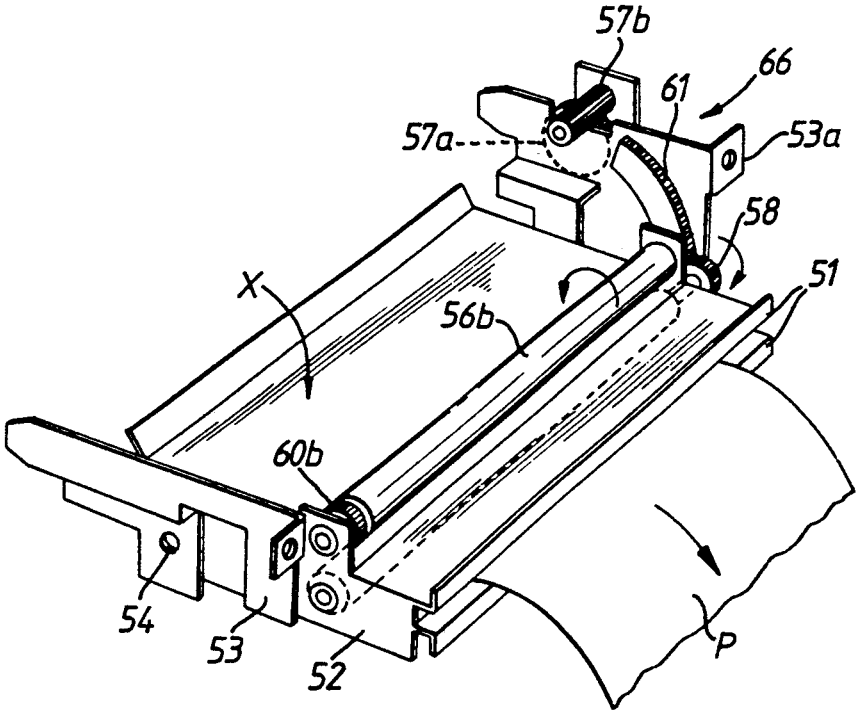
FIG. 3 is a perspective view showing the state in which the paper conveying apparatus of the first embodiment is turned.

FIG. 1 shows an internal construction of the whole of image forming apparatus 100. Image forming apparatus 100 is composed as follows. Main body 1 houses image forming process unit 2, which executes charging, exposure, developing, image transferring, paper separating, cleaning, discharging and fixing, and automatic duplex device 4 which reverses a paper P. Image forming apparatus 100 also has original table la on its top, and, on its right-hand side, first paper supply cassette 7 with manual paper supply tray **7*a* fitted on top. Paper supply unit 8 supports second to fourth paper supply cassettes 8*a* to 8*c* so that they are free to be inserted or removed. Drum-shaped photosensitive body 10 as an image carrier is provided in the center of main body 1. Main charger 11, exposure position 12*a* of optical scanner device 12, developing device 13, transfer/separation charger 14, cleaning device 16 and discharging device 17, which compose image forming process unit 2, are sequentially arranged on the periphery of photosensitive body 10** along the direction of it rotation.

Paper conveying path 22 is formed inside main body 1. This paper conveying path 22 passes through image transfer stage **14*a* between photosensitive body 10 and transfer/separation charger 14. Paper conveying path 22 guides paper supplied from paper supply cassettes 7, 8*a* to 8*c*, manual paper supply tray 7*a* and automatic duplex device 4 to paper receiving tray 18 installed on the left-hand side of main body 1**.

Various devices are arranged along paper conveying path 22. That is, first aligning roller pair 24 is arranged in the vicinity of image transfer stage **14*a*, on the upstream side. This first aligning roller pair 24 aligns the leading edge of the paper, and conveys the paper by synchronising the leading edge of the paper with the leading edge of the toner image formed on photosensitive body 10. Conveyor belt 26, fixing roller 27, conveyor roller pair 19, exit roller pair 28, and also gate 29**, are arranged on the downstream side of paper conveying path 22. This gate 29 guides paper P either toward exit roller pair 28 or toward reverse conveying path 4c of automatic duplex device 4.

First to fourth pick-up rollers 37a, 37b, 37c and 37d, which extract the paper sheet by sheet, are arranged in the vicinity of the positions in which first to fourth paper supply cassettes 7 and 8a to 8c are inserted. Also provided are first to fourth feed rollers 38a to 38d which receive the paper extracted by pick-up rollers 37a to 37d and feed the paper to paper conveying path 22. Fifth pick-up roller 4b, which extracts paper from paper stacker 4a, and fifth feed roller 38e, which feeds the paper from fifth pick-up roller 4b to paper conveying path 22, are arranged on the paper extraction side or automatic duplex device 4.

Paper P is extracted from any of second to fourth paper supply cassettes 8a to 8c, fed sheet by sheet by second to fourth feed rollers 38b to 38d, and then guided to unit-side guide plates 42 by fourth and third aligning rollers 40 and 41. The following is a detailed description of guide unit 50 as the paper conveying device which conveys paper P toward first aligning roller pair 24 of main body 1.

A pair of plate-shaped guide plates 51 face each other across a part of paper conveying path 22 from paper supply unit 8 to first aligning roller pair 24. These plates 51 are incorporated with holders 52 which are provided on both sides. These holders 52 are incorporated with the side cover 1b side of main body 1 and are capable of turning about pivot axis 54 which are mounted to guide frames 53 and 53a provided in main body 1. Second aligning roller pair 56 as a pair of conveyor rollers, which conveys paper P passing through guide plates 51, are supported by holders 52 so that they can turn as one with guide plates 51.

Driving mechanism 66 will now be described. Second aligning roller pair 56 comprises drive roller 56a and driven roller 56b. Drive gear 58 is mounted at one end of drive roller 56a. This drive gear 58 engages with aligning gear 57b. This aligning gear 57b is rotated by paper supply side gear 57a. This paper supply side gear 57a is driven by a paper supply motor (not shown) which also drives pick-up rollers 37b to 37d and feed rollers 38b to 38d via a transmission mechanism such as a clutch during the conveying of paper P. On the opposite side of drive gear 58, first and second gears 60a and 60b are provided to transmit the drive of drive roller 56a to driven roller 56b.

Arc-shaped rack 61 is mounted on guide frame 53a. Drive gear 58 separated from aligning gear 57b engages with arc-shaped rack 61 through the turning of guide plates 51. Handle 51a is formed on guide plates 51.

First to fourth sensors 63a to 63d and sixth sensor 64, which detect the passage of paper P, are arranged along paper conveying path 22.

The operation of the present invention will now be described. Original document D is set on original table 1a, image forming conditions such as number of copies, copy magnification and paper size are inputted from an operation panel (not shown), and the 'Copy' key (not shown) is operated. The copy operation is started in this way, and main body 1 and paper supply unit 8 commence the image forming operation. Photosensitive body 10, developing device 13 and cleaning device 16 are driven and, at the same time, first aligning roller pair 24, conveyor belt 26, fixing roller 27, conveyor roller pair 19 and exit roller pair 28 are also driven. Then, the respective processes of charging, exposure and developing are sequentially executed with the rotation of photosensitive body 10, and a toner image is formed on photosensitive body 10.

At the same time, for instance, third pick-up roller 37c is driven in paper supply unit 8. When paper P is supplied from third paper supply cassette 8b, paper P is fed from third paper supply cassette 8b by third feed roller 38c. Then, paper P is conveyed to guide unit 50 along guide plates 42 by third aligning roller 41. In guide unit 50, second aligning roller pair 56 are rotated as one with drive gear 58, which engages with aligning gear 57b, via paper supply side gear 57a driven by the paper supply motor. Thus paper P can be conveyed toward first aligning roller pair 24 along guide plates 51.

Paper P conveyed between guide plates 51 is temporarily stopped at the position of first aligning roller pair 24. Paper P is then conveyed to image transfer stage 14a in synchronisation with the toner image formed on photosensitive body 10, and the toner image is transferred on paper P. Then paper P is separated from photosensitive body 10, conveyed by conveyor belt 26 to fixing roller 27, and the toner image is fixed on paper P. In the case of single-side copying, the whole of the copying operation is complete, and paper P is dispensed toward paper receiving tray 18 by gate 29, passing through conveyor roller pair 19 and exit roller pair 28. In the case of both-sides copying, paper P is collected in paper stacker 4a from reverse conveying path 4c by gate 29, and awaits the copying of the other side of the paper. After completion of transferring of the toner image on the paper, photosensitive body 10 is made ready for the next copy through cleaning device 16 and discharging device 17.

The following is a description of the removing of a paper jam occurring in guide unit 50 while executing a copying operation in the above way. When a paper jam occurs and that fact is detected by second sensor 63b, the copying operation is immediately stopped. At the same time, the fact that the location of the paper jam is in guide unit 50 is displayed on a display panel on an operation panel (not shown) .

Figure 4:
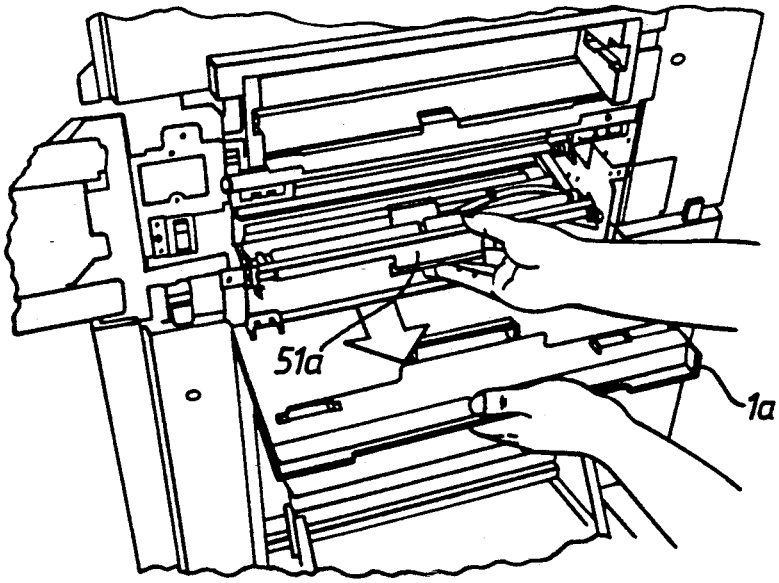
FIG. 4 is a perspective view showing a jammed paper removing operation according to the first embodiment.

Then the operator opens side cover lb of main body 1, as shown in FIG. 4, and turns guide plates 51 about pivot axis 54 in the direction of arrow X toward the outside of the apparatus. By this means, drive gear 58 is disengaged from aligning gear 57b and is engaged with rack 61. With the turning of guide plates 51, drive gear 58 is rotated by rack 61, and second aligning rollers 56 are rotated together with this. Therefore, second aligning rollers 56 transport the paper which caused the paper jam in guide plates 51 toward the leading edges of guide plates 51 and automatically makes the paper project from the leading edges of guide plates 51. By this means, the operator can pull out the leading edge of paper P projecting from guide plates 51 and can remove the jammed paper. After this, guide plates 51 are returned to the position in main body 1 where drive gear 58 and aligning gear 57b engage. Then side cover 1b is also returned to its original position, and the jammed paper removing operation is completed.

When paper P jams in guide unit 50, the operator can make the leading edge project by automatically transporting paper P toward the leading edges of guide plates 51 using second aligning rollers 56, without turning second aligning rollers 56 manually, simply by opening side cover 1b and turning guide plates 51 outward. Thus, since this produces a state in which the paper is always easy to pull out, the jammed paper removing operation can be significantly shortened in comparison with prior art. Therefore, the operability of jammed paper removing can be improved.

The second embodiment of the present invention will now be described referring to FIGS. 5 to 7.

In this second embodiment, the apparatus shown in the first embodiment was additionally provided with an automatic document feeding function by an automatic document feeder and a function to automatically remove jammed paper in this automatic document feeder.

With the exception of the above points, the second embodiment is the same as the first embodiment and the same parts in the second embodiment as those in the first embodiment are assigned with the same reference numerals, omitting the explanations thereof.

Figure 5:
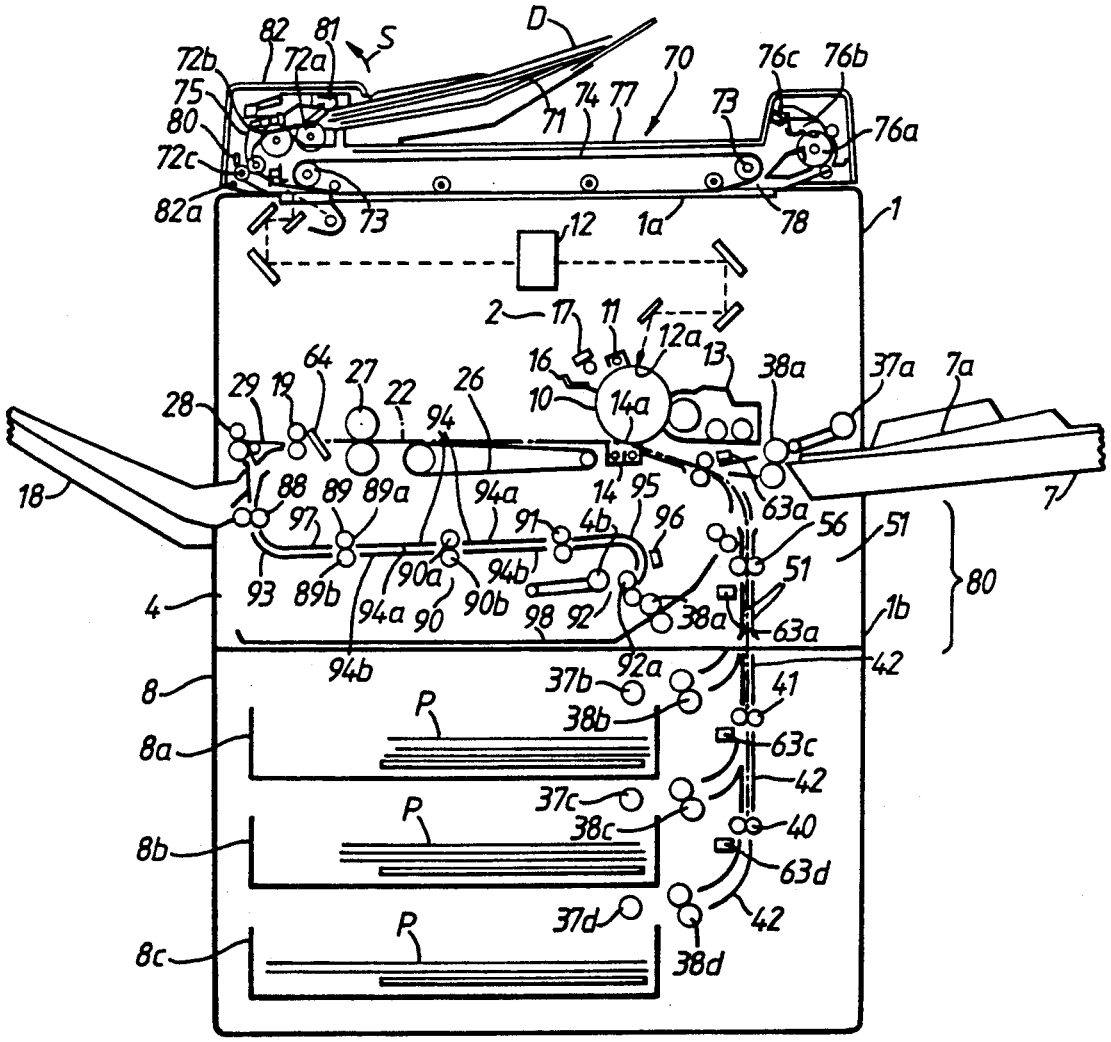
FIG. 5 is a sectional view showing an image forming apparatus in which paper conveying apparatus according to a second and third embodiments of the present invention is accomodated.
Figure 5A:
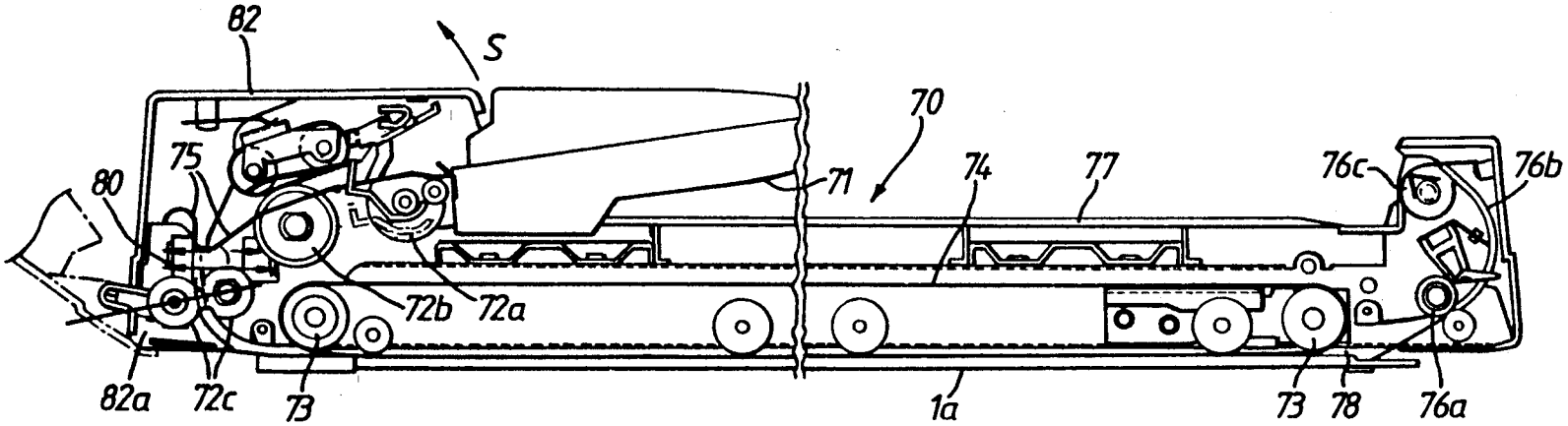
FIG. 5A is a sectional view showing an automatic document feeder in which the paper conveying apparatus according to the second embodiment is accomodated.

As shown in FIGS. 5 and 5A, automatic document feeder 70 is provided above main body 1 to automatically supply original documents to original table 1*a*. This automatic document feeder 70 is provided with original conveying path 78 to supply original document D from document tray 71 onto original table la through pick-up roller 72*a*, loosing roller 72*b*, guide plates 75 and aligning roller pair 72*c* by conveyor belt 74 that is laid between the belt rollers 73. Automatic document feeder 70 is further provided with an original conveying path 78 which, after completing the exposure, ejects original document D to receiving portion 77 side via reversing roller 76*a*, flapper 76*b* and exit roller 76*c* by conveyor belt 74 Aligning sensor 80 is arranged in the vicinity of aligning roller pair 72*c* to detect arrival of original document D.

Figure 6:
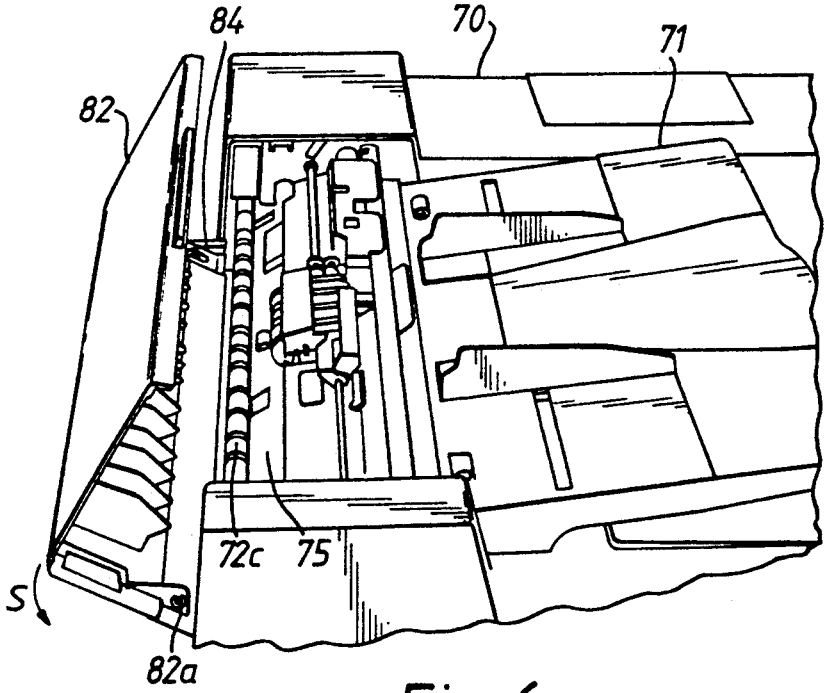
FIG. 6 is a perspective view showing the state in which a cover plate of the automatic document feeder is opened in the second embodiment.
Figure 7:
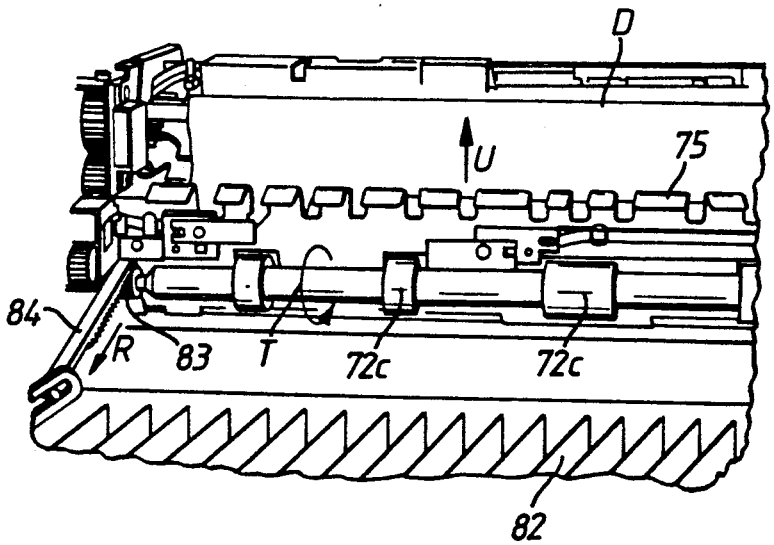
FIG. 7 is a explanatory diagram showing the state when ejecting a jammed paper from the paper conveying apparatus in the second embodiment.

As shown in FIGS. 6 and 7, cover plate 82 covers the original take-in side of original conveying path 78 extending from the pick-up roller 72*a* to aligning roller pair 72*c* and is rotatable around pivot axis 82*a*. On the side opposite to aligning roller 72*c* of cover plate 82, first rack 84 is mounted to engage with first gear 83 mounted to aligning roller 72*c* when cover plate 82 is open. To keep first rack 84 from disengaging from first gear 83, another end of first rack 84 is pressed against first gear 83 side by a spring (not shown). Accordingly, when cover plate 82 is opened, first rack 84 is moved in the arrow direction R. In accordance with the moving of first rack 84, first gear 83 is rotated in the arrow direction T. The power of a driving source (not shown) is transmitted to aligning roller 72*c* via an electromagnetic clutch (not shown), while aligning roller 72*c* is disconnected from the driving source when aligning roller 72*c* is not driven as cover plate 82 is open.

The following is a description of the removing of a paper jam occurring in automatic document feeder 70 while executing a copying operation. When a paper is jammed in automatic paper feeder 70 and that fact is detected by aligning sensor 80, the automatic document feeding operation is stopped immediately. Then, the electromagnetic clutch is turned off and aligning roller 72 is disconnected from the driving source. At the same time, the display panel on the operation panel indicates that the paper jamming point is at the original document take-in side of original conveying path 78.

When an operator opens cover plate 82 in the arrow direction S to remove the jammed paper, first rack 84 is pulled to the arrow direction R while interlocking with the opening motion of cover plate 82. As a result, first gear 83 meshing with this first rack 84 is rotated in the arrow direction T and aligning roller 72 is rotated in the same direction.

Accordingly, aligning roller 72 ejects original document D which caused the paper jamming in guide plate 75 in the arrow direction U and automatically ejects its trailing edge from guide plates 75. Then, after removing the jammed paper by pulling the trailing edge of original document D ejected from guide plates 75 upward, the operator closes cover plate 82 and terminates the jammed paper removing operation.

As described above, if original document D is jammed at the original taken-in side of original conveying path 78 in automatic document feeder 70, the trailing edge of original document D can be ejected automatically from guide plate 75 only when cover plate 82 is opened. The subsequent paper removing operation by operator is facilitated.

The third embodiment of the present invention will now be described referring to FIGS. 5 and 8 to 11.

In this third embodiment, the apparatus shown in the first embodiment was additionally provided with a function to automatically remove jammed paper in automatic duplex device 4.

Figure 8:
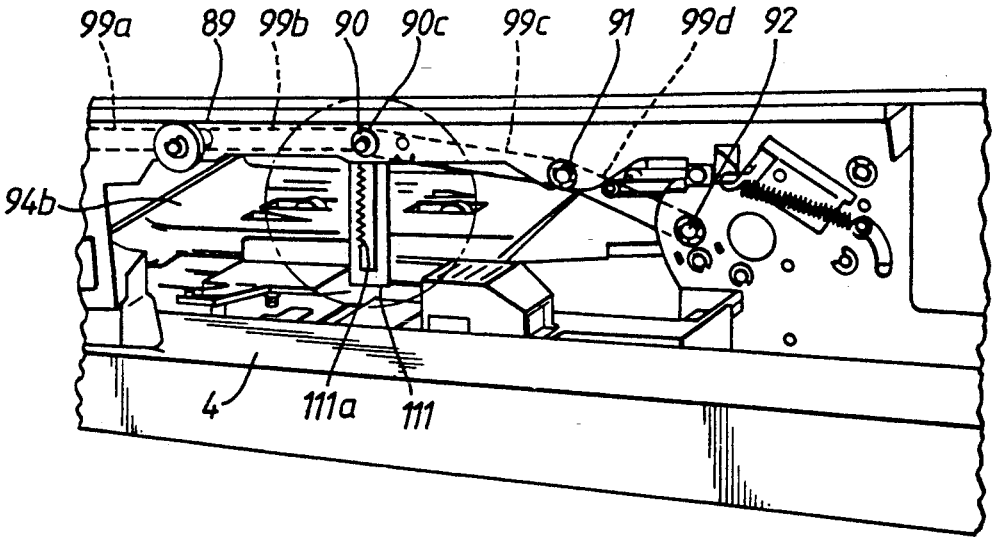
FIG. 8 is a perspective view showing the state in which a lower conveyor path of an automatic duplex device is opened in the third embodiment.

The construction of automatic duplex device 4 will now be described. Automatic duplex device 4 stacks paper P in the reversed state in stacker 98 from gate 29 through reversing conveyor path 97 consisting of first to fifth conveyor rollers 88, 89, 90, 91 and 92 and first to third conveyor guides 93, 94 and 95. Then, automatic duplex device 4 takes out paper P again to paper conveying path 22 side by fifth pick-up roller 4*b*. The driving power from a driving source (not shown) is transmitted to first to fifth conveyor rollers 88 to 92 by first to fourth timing belts 99*a* to 99*d*, as shown in FIG. 8. That is, first timing belt 99*a* is laid between first conveyor roller 88 and second conveyor roller 89. Second timing belt 99*b* is laid between second conveyor roller 89 and third conveyor roller 90. Third timing belt 99*c* is laid between third conveyor roller 90 and fourth conveyor roller 91. Fourth timing belt 99*d* is laid between fourth conveyor roller 91 and fifth conveyor roller 92. Sensor 96 is arranged at the position of third conveyor guide 95 to detect the passage of paper.

Second conveyor guide 94 comprises lower guide plate 94*b* and upper guide plate 94*a* facing each other. Lower guide plate 94*b* of second conveyor guide 94 out of conveyor guides 93 to 95 is mounted in such a manner that lower guide plate 94*b* supports lower rollers 89*b* and 90*b* of second and third conveyor rollers 89 and 90 and its front side is opened while rotating around the rear side end. Second rack 111 having meshing portion 111*a* is mounted at the front side of lower guide plate 94*b*, Second gear 110, which is mounted to shaft 90*c* of upper roller 90*a*, meshes with meshing portion 111*a* of second rack 111. Therefore, when lower guide plate 94*b* is opened, second gear 110 is rotated by the second rack 111. When first to fourth timing belts 99*a* to 99*d* are driven by the power from a driving source (not shown), the driving power is transmitted to first to fifth conveyor rollers 88 to 92 through an electromagnetic clutch (not shown), while first to fourth timing belts 99*a* to 99*d* are separated from the driving source when lower guide plate 94*b* is open. Further, as meshing portion 111*a* is not formed at the upper and lower portions of second rack 111, second gear 110 is freely rotatable at this positions.

Figure 10:
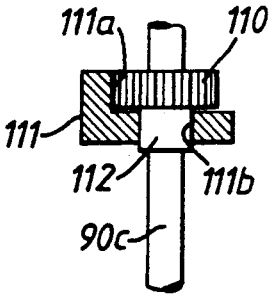
FIG. 10 is a cross-sectional view showing the second gear and the second rack in the third embodiment.

As shown in FIG. 10, boss 112 is formed in one unit with second gear 110. Flat portion 111*b* opposing to meshing portion 111*a* of second rack 111 is kept in contact with boss 112 to prevent second gear 110 from returning by getting second gear 110 and boss 112 dammed between meshing portion 111*a* and flat portion 111*b* when the operation is kept suspended.

The following is a description of the removing of a paper jam occurring in automatic duplex device 4 while executing a copying operation. When a paper is jammed in automatic duplex device 4 and that fact is detected by sensor 96, the copying operation is stopped immediately and first to fourth timing belts 99*a* to 99*d* are separated from the driving source. At the same time, the display panel on the operation panel indicates that the paper jamming point is in third conveyor guide 95.

To remove the paper jamming, an operator opens a front cover (not shown) of main body 1, then the operator pushes down lower guide plate 94*b* to open the conveyor path 97. Interlocking with this, second rack 111 is pulled down from the position shown in FIG. 9A to the position shown in FIG. 9C through the position shown in FIG. 9B. Second gear 110 meshing with this second rack 111 is rotated in the arrow direction V, and the driving side 92*a* of fifth conveyor roller 92 is thus rotated in the same direction through third and fourth timing belts 99*c* and 99*d*.

Figure 11:
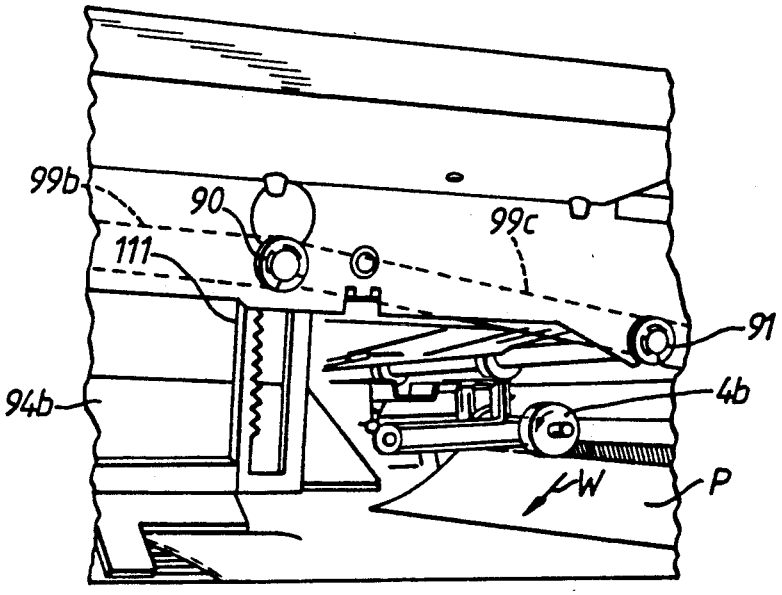
FIG. 11 is a explanatory diagram showing the state when ejecting a jammed paper from the paper conveying apparatus in the third embodiment.
Figure 9A:
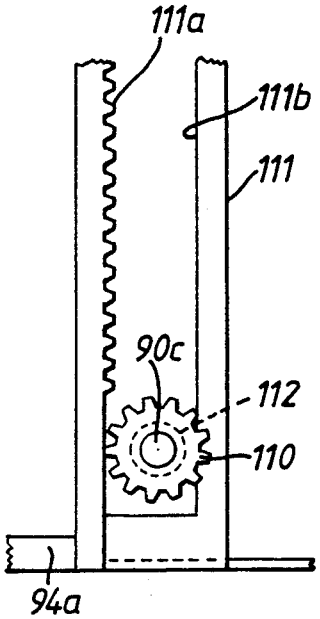
FIGS. 9A to 9C are explanatory diagrams showing the rotation of a second gear by a second rack in the third embodiment.
Figure 9B:
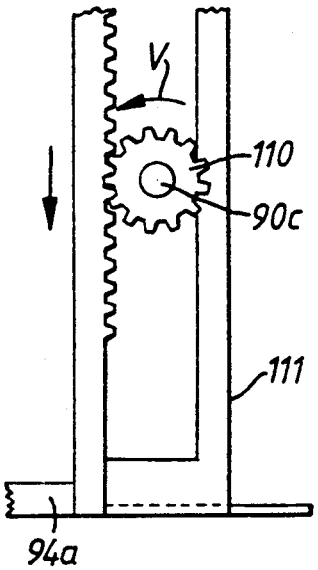
Figure 9C:
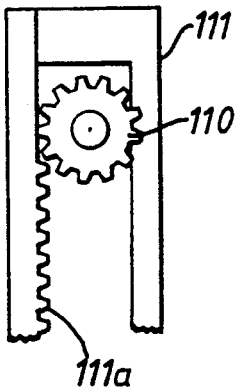

As a result, fifth conveyor roller 92 conveys paper P jammed in third conveyor guide 95 to stacker 98 side and automatically ejects its leading edge in the arrow direction W from third conveyor guide 95 (FIG. 11). After removing the paper jammed in third conveyor guide 95 by pulling out the leading edge of the ejected paper P to stacker 98 side, the operator closes lower guide plate 94*b*, closes the front cover and terminates the jammed paper removing operation.

As described above, if paper P is jammed in third conveyor guide 95 of in automatic duplex device 4, the leading edge of paper P can be ejected automatically from third conveyor guide 95 only when lower guide plate 94*b* of conveyor path 97 is opened, thus facilitating the paper removing operation by operator.

According to the present invention if paper is jammed, it is possible to eject the jammed paper out of a guide means automatically only by opening a conveyor path by rotating the guide means or a rotating means near a conveyor path by operator. Thus, when a paper is jammed in the guide means, the jammed paper can be pulled out of the conveyor path easily by the operator. Consequently, it is possible to remove paper jamming more easily in a shorter time than before and the operability of a paper conveying device in removing paper jamming can be greatly improved.

Further, the present invention is not limited to the above embodiments but is variable within a range where what are intended by the invention are not changed, and is not limited to a copying apparatus only if a paper conveying path is provided and furthermore, positions of guides and conveyor rollers can be set optionally.

What is claimed is:

1. An apparatus for conveying a paper along a paper conveying path, comprising:

means for guiding a paper in the paper conveying path, the guiding means including a pair of plate-shaped guide plates facing each other across the paper conveying path;

roller means, provided with the guiding means, for conveying the paper along the guiding means by the rotation thereof, the roller means including a pair of conveyor rollers respectively mounted adjacent the pair of guide plates;

means for supporting the guide plates movably between a first position located in the paper conveying path and a second position located out of the paper conveying path; and means for rotating the roller means associated with the movement of the guide plates from the first position to the second position, the rotating means including a gear mounted at one end of one of the pair of conveyor rollers and a stationary rack engaging the gear to rotate the one conveyor roller.

* * * * *